United States Patent [19]

Toland

[11] 4,292,822

[45] Oct. 6, 1981

[54] APPARATUS FOR RANDOMLY COLORING PILE FABRIC

[75] Inventor: James Toland, Dalton, Ga.

[73] Assignee: World Carpets, Inc., Dalton, Ga.

[21] Appl. No.: 866,913

[22] Filed: Jan. 4, 1978

Related U.S. Application Data

[62] Division of Ser. No. 832,905, Sep. 13, 1977, Pat. No. 4,189,302.

[51] Int. Cl.[3] ..... D06B 21/00

[52] U.S. Cl. ..... 68/5 D; 68/205 R

[58] Field of Search ..... 68/13 R, 200, 205 R, 68/5 D; 118/315, 325

[56] References Cited

U.S. PATENT DOCUMENTS 4,010,709 3/1977 Sayman et al. ..... 68/205 R X

*Primary Examiner*—Philip R. Coe

*Attorney, Agent, or Firm*—Kerkam, Stowell, Kondracki & Clarke

[57] ABSTRACT

Apparatus for randomly coloring a pile fabric material includes a preconditioning unit for pretreating the fabric to be dyed with a wetting agent, a conveyor for conveying the pretreated fabric continuously through a series of operating stations including a gum applicator for application of a viscous gum coating and thereafter to a roll dye applicator for application of a first dye color which penetrates the gum coating prior to being set. The first dye color is of a relatively low viscosity, much lower than that of the gum, to allow said dye color to overrun the tips of the yarn. The tips of the yarn remain relatively undyed by the first dye color which settles mostly at the lower base position of the carpet yarn.

For application of additional dye colors, additional successive dye applicators may be used. In such event the dye colors applied are different visosities. The first applied dye color is preferably of a viscosity greater than that of the second applied dye color and may be included within the gum. The first applied dye thus shields the tips of the yarn from the second applied dye which penetrates the gum coating and runs down and around the tips of the yarn. Thus, the base portions of the yarns of the fabric are dyed by the second applied dye color, and the first applied dye color serves to dye the tips of the yarn after the fabric is conveyed to a steamer where the gum is dissolved. A third color may be applied by predyeing the face yarn in a pad applicator prior to application of the gum coating. By preselecting the number of applicators and the viscosities of the dyes, selected blending of dyes may be effected to achieve multiple color effects.

6 Claims, 9 Drawing Figures

APPARATUS FOR RANDOMLY COLORING PILE FABRIC

This is a division of application Ser. No. 832,905, filed Sept. 13, 1977, and now U.S. Pat. No. 4,189,302.

BACKGROUND OF THE INVENTION

This invention relates to apparatus for dyeing textiles, especially carpets and pile fabrics, with different colors or tones of color by means of application of dye colors to the topside or pile face continuously conveyed textile fabric.

Styling trends play an important role in the textile industry. Much emphasis has been placed of late on finishing a single color carpet in such a way that although the single color remains the predominant base tone, a liveliness or an optically improved effect is obtained by dissolving the single color within a blend of dyes to achieve differing tones up to a degree of color differences. In such carpets, the appearance of the surface does not appear in regularly recurring designs or patterns. Nor does the carpet styling take on a geometrically defined outline or the like or as repeated portions. Rather, the carpet has a certain unified effect of a randomness which is pleasant to the eye.

Such a type of carpet dyeing process has been commonly designated as "space dyeing". This type of patterning has further achieved significance in other fabrics, as for example decorative fabric materials so that this invention, which is preferably intended for carpets, is not limited to the same.

Various processes and apparatus have been developed to facilitate such space dyeing of textiles. For example, it has been proposed to space dye yarn and use this space dyed yarn to tuft carpets as suggested for example, in U.S. Pat. No. 3,986,375, to O'Mahoney et al. Another proposal of space dyeing is known as the "knit-de-knit" process wherein the yarn is knitted into a prefabric, striped or other patterns are applied on the yarn which is then heat set and unravelled to produce a space dyed yarn suitable for use in fabrication of carpet. A typical process of this type is further described in U.S. Pat. Nos. 3,012,305 and 3,102,322 to Whitaker.

The latter proposals relate to dyeing of the yarn used in tufting carpet. It is likewise known to achieve desirable styling by dyeing piece material. For example, resort has been made to the use of resist materials applied to the surface of the yarn which prevents the tips of the yarn from accepting dye. Such a process is disclosed in U.S. Pat. No. 3,999,990 to Freeman.

In this process, the pile face is first treated with a dye and then, while still wet, the upper portions of the pile are treated to a uniform depth with a resist chemical capable of displacing the dye from the upper portions of the pile face. Alternatively, the resist chemical is applied first. In any event, the dye receptivity of the tips are modified by altering the dye sites in the fibers.

The application of resist chemicals produces a desirable frosting or halo effect due to undyed tips, but the appearance of such fabrics can be harsh.

Another proposal has been to apply colors in a spotted fashion by individual dye droplets in equal volume over the undyed surface of the carpet breadth which is continuously transported. The application of the dye droplets is effected according to the random colors or tones to be desired without any repeated pattern or design. Apparatus to effect such dyeing is disclosed in U.S. Pat. No. 3,271,102 to Morgan.

Still another proposal suggests the use of a viscous gum coating which is applied as a barrier layer on the undyed pile face of the carpet web. As the web is transported, the desired dye is applied by a conventional tak dyeing technique, i.e. the dye is splattered on the barrier layer and forms pools or puddles. Inasmuch as the barrier layers is of relatively high viscosity in the order of 3000 c.p.s., the dye does not penetrate the barrier layer until the carpet is dissolved in a steamer and the dye descends toward the carpet base. Such as proposal is disclosed in U.S. Pat. No. 4,010,709 to Sayman et al. This process is referred to in the trade as a gum-tak process.

While each of the foregoing techniques has certain advantages, each also has certain limitations. The most common problems are chevroning or striping which shows up most frequently when using space dyed yarns, bleaching of tips when using resist chemicals and splotching most frequently occuring in tak methods. The gum tak process is intended to overcome splotching due to abruptly changing color patterns, but in order to effect such changes it requires the modification of existing apparatus which in the first instance requires an initial investment of substantial number of dollars. Considering the intial investment and the fact that a continuous dyeing line involves several pieces of equipment, each of which itself is relatively expensive, costly modifications to existing apparatus should obviously be avoided.

Notwithstanding the fact that a particular process and apparatus therefor might be more advantageous to one manufacturer than another or preferred by certain manufacturers over other processes and apparatus, continuous changes in styling trends and ever changing public tastes and demands for color patterns which are away from the ordinary have placed pressure on the industry to develop processes and apparatus capable to varying non-repetitive random color patterns to achieve new and unusual visual effects. It has always been desired to enhance the surface interest and appearance of textile materials to provide increased decorative and esthetic appeal.

Accordingly, it is a principal object of the present invention to create a textile fabric and particularly a pile fabric having a novel multicolored effect by an improved dyeing process.

It is another principal object of the present invention to provide an improved apparatus for continuously dyeing textile piece materials to produce a material having unique visual styling qualities not heretofore achieved by known continuous dyeing processes.

Another object of the present invention is to achieve improved color mixing and color blending of dyes in individual face yarns of a textile fabric through a continuous dyeing process.

Another object of the present invention is to create usual styling effects in piece dyed textile materials by application of multiple dye colors to the pile face of a continuously conveyed textile carpet.

A further object of the present invention is to provide an improved dyeing apparatus for dyeing of textile piece fabrics which facilitates tip dyeing of face yarns with one color and dyeing of the remainder of the face yarns with one or more other colors.

Still another object of the invention provides an improved apparatus for dyeing shag or cut loop styles of carpet, but which can likewise be used on other styles and is readily adapted to employ existing dyeing equipment without change and with obvious economic advantages.

Other features and advantages of the invention will become apparent to those skilled in the art upon a reading of the following description.

SUMMARY OF THE INVENTION

In accordance with the present invention, there is provided apparatus for randomly coloring a pile fabric material conveyed continuously through several treating stages. The pile fabric is pretreated or wet out in a pad applicator with a suitable wetting agent. If desired, the pile fabric may have a single background color applied to it by the pad applicator prior to application of the other colors or dyes to the pile face. From the pretreating stage, the carpet is conveyed to a gum applicator which applies across the tips of the pile without prior settng of the colors a thin coating of clear gum or gum dye solution having a viscosity in the range of 100 to 2000 c.p.s. The fabric having a blanket coating of gum over the tips of the pile yarns is then moved to a dyeing station for application by means of a roll applicator a blanket or layer of dye having a viscosity in the range of 20 to 400 c.p.s. The free flowing dye material penetrates the gum and runs over the tips and is accepted by the carpet pile so that the primary color is applied substantially at the base of the pile yarn.

One or more additional dyeing stages may be used for the application of additional colors to effect dyeing of the tip and varying color effects. Where multiple colors are used, dye may be added to the viscous gum material to form a gum-dye solution or may be separate therefrom. Preferably, the first dye color is mixed with the gum layer and the gum-dye solution has a viscosity greater than that of the second applied dye color. The second applied dye color penetrates the first layer of dye and the gum layer and runs over the tips of the yarn toward the base of the fabric. The pile fabric is then conveyed to a steamer which thins out the gum and so allows any dye thereon or therein to settle on the tips of the yarn. The dye also becomes fixed or set by the steamer.

BRIEF DESCRIPTION OF THE DRAWINGS

FIG. 6 is a fragmentary cross sectional view depicting the application of a first and a second dye color over a gum layer having a first dye color thereon which acts as a temporary barrier to the second applied dye color.

FIG. 7 is a fragmentary cross sectional view taken through the carpet web illustrating the thinning out of the gum layer which occurs in the steamer stage and the setting of the dye in the tips of and in the base portions of carpet pile for establishing a color pattern thereon.

DETAILED DESCRIPTION OF THE PREFERRED EMBODIMENT

Figure 1:
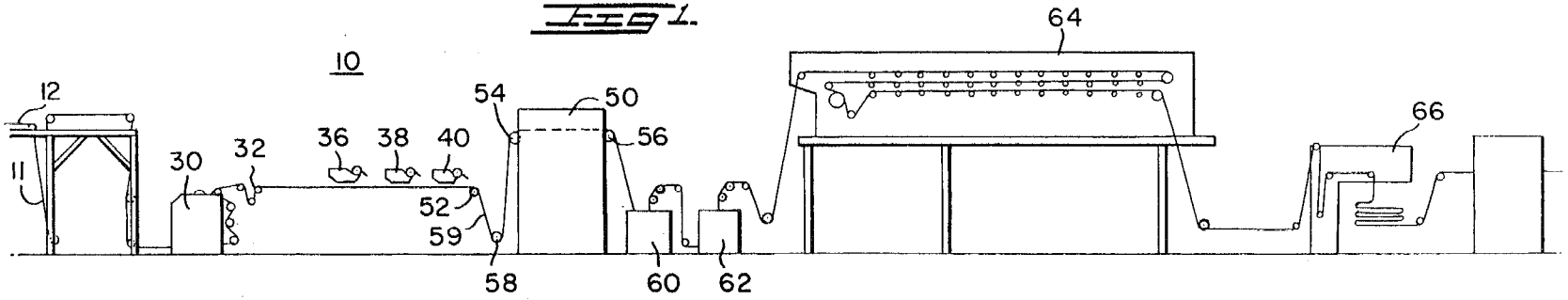
FIG. 1 is a schematic side elevational view of a carpet dyeing apparatus or system according to the present invention.

Referring to the drawings wherein like numerals designate like parts and initially considering FIG. 1, there is illustrated a complete carpet dyeing line or apparatus 10 which includes conventional guiding and infeed means 11 for a tufted carpet web or like pile fabric 12 which conventionally has a breadth of 12 or 15 feet. Referring to FIGS. 4 to 7, the tufted carpet web 12 conventionally comprises a fabricated backing 14 and a fabricated pile face 16, the fabricated backing 14 generally comprises an upper, woven primary backing fabric 18 into which pile yarns 20 have been stitched and then secured thereto additionally by an adhesive 22. A lower, woven secondary backing fabric 24 may be laminated to the adhesive and the primary backing fabric 18. Alternatively, the secondary backing may take the form of a latex or hot melt material. The pile face yarns 20 which have an upper pile face portion or tip 25 and a lower pile face or body portion 26. While illustrated in the form of a cut pile, it should be readily appreciated that the pile face may be one of a variety of styles or pattern, such as, for example, high, low loop, cut loop, shag, etc. and that the illustrated style of FIGS. 4–7 is to facilitate a description of the invention and not to limit the invention.

Referring again to FIG. 1, the guiding and infeed means 11 is driven so as to maintain a continuous supply of carpet web to a preconditioning unit 30. Prior to being fed into the preconditioning unit, the carpet web 12 is driven over a conventional back beater roller assembly, not shown, and the pile face 16 is vacuumed to remove any lint. After initial cleaning, the web 12 is transported to pre-conditioning unit 30 where a wetting agent is applied to assist in achieving proper penetration and dispersal of dye color. The conditioning unit may be a conventional Kuster pad applicator for application of a wetting agent or, if desired, the application of a base dye to shade the face yarn.

The liquid applied to unit 30 may also include a polyester solvent carrier. A suitable wetting agent is sold commercially by Union Carbide under the trade name 1559 which is a 9 mole ethylene oxide. Other examples of suitable agents are benzyl alcohol and a non-ionic wetting agent such as a polyether alcohol sold on the market under the name Deceresol NI. Other conventional wetting agents and solvents may likewise be used such as, for example, ethylene oxide or ethoxylated alcohol, and the particular solvent or wetting agent chosen should avoid damage to the fibers present in the fabric. The above chemicals in relatively weak solutions are all satisfactory for both natural and synthetic yarns used in pile fabrics.

The application of the pretreating liquid to the face of the pile of the fabric is important in obtaining a level dyeing effect which is essential from the standpoint of appearance and saleability of the final product. This pretreating step solubilizes the later applied dyestuff and disperses it uniformly throughout the fiber during the subsequent steam treatment. The liquid carriers assist color penetration into the yarns so that an extremely satisfactory and thorough dyeing result is produced. The subsequent steaming operation completes the dispersion and transfer of the color to all parts of the fabric and also fixes the color.

During pretreatment or wet out as the process is called, background color may be imparted to the carpet pile prior to application of the gum and dye at a downstream dyeing station or stations, to be described. The application of a background color is particularly advantageous for light weight carpets to minimize the objectionable appearance of undyed backing or undyed portions of lower pile face which might become visible upon separation of the pile face yarn. Upon leaving the pad applicator 30 the background color dye is not fixed in the carpet pile so that blending of dye colors may be achieved as desired with later applied dye colors. From the pad applicator 30, the web 12 advances through a system of guide rolls 32 to a series of roll applicators unit 36, 38 and 40, shown in greater detail in FIG. 2. The roll applicator units are arranged at spaced intervals of approximately 2½ feet, while the carpet web is fed therethrough in a substantially horizontal plane.

Figure 2:
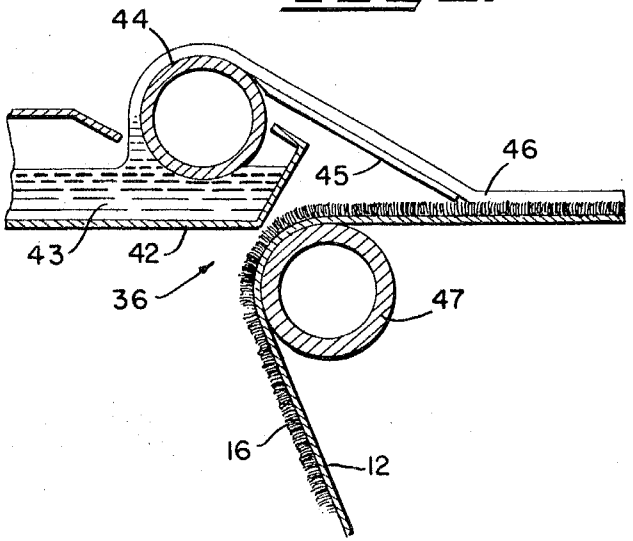
FIG. 2 is an enlarged fragmentary vertical section taken through a viscous gum coating unit employed in the invention downstream from the wet out stage of the system shown in FIG. 1.

Referring now to FIG. 2, it will be seen that each applicator 36, which is located downstream of pad applicator or pretreating stage 30 comprises a feed trough 42; trough 42 may be filled with a supply of inert viscous natural gum 43 maintained at a constant level when used for gum application or a supply of dye stuff of predetermined color when used for dye application. A rotatably driven pick-up roll 44 takes the gum or dye coating 43 from the trough 42 and delivers it to a doctor blade 45 from which the coating is delivered. Because of the closeness of the yarns and the thickness of the gum, the gum takes on the form of a continuous layer 46 approximately ⅛ to ¼ inch thick which covers the pile face 16 of carpet web 12, as shown in greater detail in FIG. 4. The dye, being of lower viscosity, is normally applied in a layer of about ¼ to ⅛ inch thick. A leveling roll 47 adjacent the applicator 36 is disposed beneath the doctor blade so that the carpet web 12 is transported directly beneath the blade 45 with the pile face 16 facing upwards to receive the viscous gum coating.

In accordance with the present invention, the gum coating is advantageously of a sufficient viscosity to cause the gum coating to form a blanket coating extending over the tips of the pile face 16, but not so great as to prevent penetration by a later applied dye color. The viscosity of the gum is in the range of 100 to 1600 c.p.s. and preferably in the range of 400 to 1000 c.p.s. The gum may be selected from any one of a number of commercially available gums such as, for example, General Mills Galaxy 1069 and is clear, that is free of any dye coloring, but as will be apparent, where multiple dye colors are applied, the gum may serve as a carrier for one of the dye colors to achieve a desired coloration of the fabric.

After application of the heavier viscosity coating, the carpet web 12 continues its travel along a substantially horizontal plane to one or more further dye application stations 38, 40 for successive application of dye color to the face yarn. Each station may take the form of a roll applicator as shown in FIG. 2, but instead of the trough 42 being filled with gum, the through is filled with a dye solution maintained at a constant level. The dye is advantageously of a viscosity less than that of the viscous gum and in the range of approximately 20 to 400 c.p.s. The lower viscosity of the dye is selected to permit the dye to penetrate the gum layer and smoothly flow through the gum layer 43 and over the tips 25 of the pile face 16 toward the lower pile face or body portion 16. Thus, the majority of the coloring flows downward beyond the tip, although some tip toning may take place.

The carpet web 12 may then be transported directly to a steamer 50 maintained at an elevated temperature of about 212 degrees Fahrenheit for fixing the dye. Inasmuch as the major portion of the dye has passed beyond the tip 25 toward the body portion 26, the net result after fixation is an aesthetic smoky or haze effect where the main portion of the dye color it set in the body portion 26 while the tip 25 of the pile face 16 is free from color or shaded in a corresponding contrasting color tone, but much lighter. It should be noted that by controlling the viscosity of the applied dye and that of the gum coating, the amount of tip dyeing is selectively controlled. That is to say, a higher viscosity dye will not flow as freely beyond the tips 25 of the individual pile yarns 20 and thus result in a greater concentration of color at the tips than is the case.

After application of the dye, continued movement of the web 12 transports it into a conventional steamer 50 of a vertical or horizontal type wherein the color is fully dispersed and set or fixed. To this end, web 12 is advanced by a powered pin roll 52, there being a secondary driven pin roll 54 within the steamer 50 engaging the carpet web 12 and a final drive roll 56 near the exit end of the steamer. A compensating roll (not shown) within the steamer maintains proper tension on the carpet web inside the steamer and also regulates the speed of the drive roll 56 in a conventional manner known in the art. At the input end of the steamer, the carpet web after passing the final dye applicator is provided with a slack loop 59 whose size may be regulated by a conventional slack loop control switch sensor (not shown) and bar weight 58.

The foregoing description is concerned primarily with developing a smoke or haze effect in the face yarn. The invention in its preferred embodiment is used to develop different levels of color in the face yarn directly on the piece goods and produce a unique multcolor tonal effect. To this end, in the preferred embodiment, multiple dye applicators 38 and 40 are provided between gum applicator 36 and steamer 50 for the application of preselected dye colors to the face yarns. In this preferred embodiment, the first dye color is of a greater viscosity than the second dye color. This causes the second dye color after its application to penetrate through the layer of first dye color and gum layer and run down and beyond the tips of pile yarns 20 to coat the body portions 26 thereof. Inasmuch as some mixing or run off of the first and second dye colors may occur, a slight blending of dye materials results. This blend in effect creates a dye mixture whose viscosity is not as low as the first dye and not as high as the second dye.

As a result, some penetration of the gum layer will occur thus coating the upper body portions of the face yarn resulting in a multi-color effect, after final dispersion of the gum layer, i.e. the body portion 26 will be died primarily with the second or last applied dye color; the tips 25 of the face yarn will be dyed primarily with the first applied dye color, and the area of the pile yarns directly below the tips will be dyed a blend of the two applied colors. Thus, it is important when selecting the number of dye applicators and thus the number of colors, that the colors be compatible to give pleasant visual effects.

Figure 3:
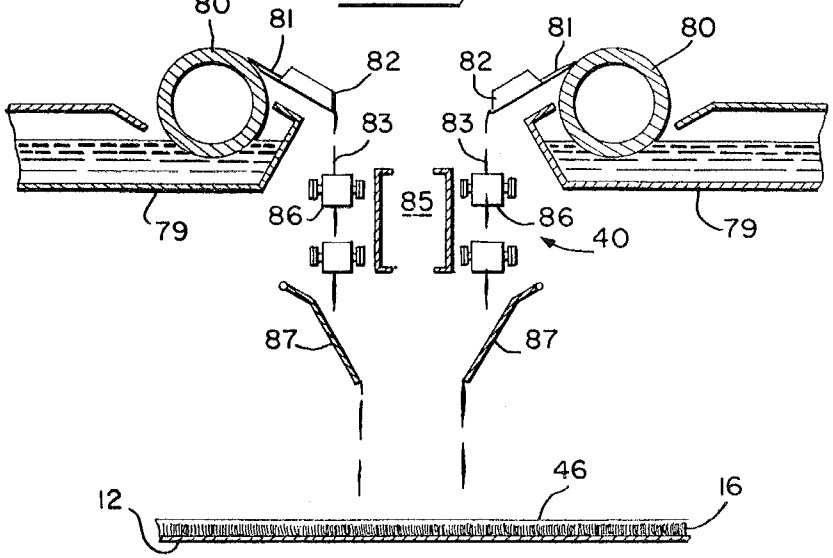
FIG. 3 is a similar cross sectional view on an enlarged scale of a tak dye applicator which may be employed in accordance with the present invention for application of dye materials downstream from the wet out stage of the system shown in FIG. 1.

For additional color and styling effects, dye applicator 40 or subsequent upstream stages of dye applicators may take form of a tac applicator shown in greater detail in FIG. 3. Such tac applicators are well known and may take any convenient form and may be such as that shown, for example, in U.S. Pat. Nos. 3,683,649 to Takrita et al, or that of 4,010,709 Sayman et al. The applicator shown in the latter patent is particularly advantageous in that it comprises dual troughs for application of two colors by the tak dye process. Such apparatus is conventional and, as shown in FIG. 3, comprises a pair of opposed identical applicator units, so that two different dye colors may be applied to the carpet or, in some cases, two applications of a single dye color of different viscosities. Each applicator unit embodies a dye trough 79 for a liquid dye or dyes of a syrupy consistency and a viscosity which is much less than that of the thick gum coating, the latter preferably having a viscosity in the range of 400 to 1000 c.p.s. The viscosity, as should be readily appreciated, must not be so great as to cause the layer to be a barrier to the flow of dye. The dye formulation is conventional and is chosen from a number of available dyes so as to be compatible with various synthetic or natural fibers or mixtures of such fibers in the pile yarns. Each applicator unit of the applicator assembly further has a dye pick-up roll 80 for delivering a uniform film of liquid dye to a coacting doctor blade 81, each having a multiplicity of inclined V cross section gutter extensions 82 by means of which the liquid dye is divided into multiple separate streams or drippings 83. Some or all of the gutter extensions 82 may be equipped with flow control plugs whereby the flow from certain gutters may be regulated or stopped completely in the interest of varying the random color pattern for the carpet.

Below the opposing sets of gutter extensions 82, a power driven endless flexible conveyor element 85, such as a sprocket chain, carries plural evenly spaced cylindrical horizontal axis stream cutters or interruptors 86 which travel continuously beneath the outlets of the gutter extensions 82 in two horizontal passes moving in opposite directions, transversely of the line of movement of the carpet web 12. The moving elements 86 constantly travel through the falling dye streams 83 and cut or interrupt the same so that the drip pattern of the liquid dye is completely random, irregular and widespread across the pile face of the horizontally moving carpet web.

Below the stream interruptors 86, stationary inclined combs 87 further intercept and break up the falling dye streams 83, again for the purpose of rendering the drip dye pattern completely random, non-uniform and non-repetitive on the carpet pile face. If desired, the comb elements 87 which are pivotally mounted can be flipped outwardly from their active positions of FIG. 3 to inactive positions clear of the falling dye streams.

Figure 4:
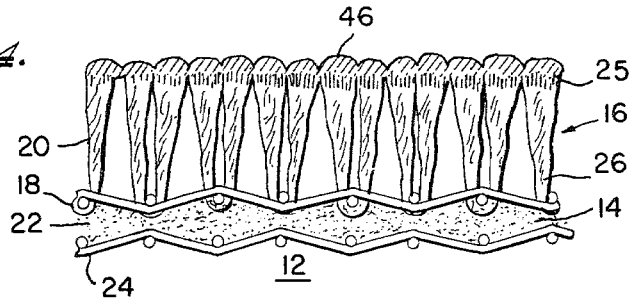
FIG. 4 is an enlarged fragmentary cross sectional view taken through the carpet web with the viscous coating forming a temporary dye barrier layer thereon on the tips of the face yarns.

FIGS. 4–7 illustrate the manner in which dyeing of the pile face 16 is effected. As shown in FIG. 4, the viscous gum coating has been applied in the form of a layer across the tips 25 of the yarns 20. The profile of the gum layer varies according to the texture of the surface of the face yarn with globs or beadlets of gum forming on the top. The coating retards the applied dyes from immediately migrating to the lower pile face or body portion 26 of the yarn which would otherwise take place during the period it takes for the carpet web 12 to travel from dye applicator station 40 to the entry point of the steamer 50, but it is important that the viscosity not be so great as to prevent penetration or to retard flow to the extent that the lower body portions of the yarn remain undyed.

Figure 5:
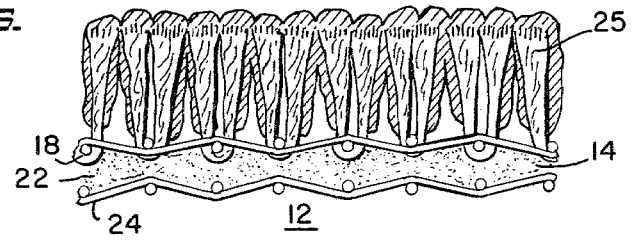
FIG. 5 is a fragmentary cross sectional view depicting the application of a single dye color onto the gum layer while the carpet web is being transported with the dye penetrating the gum layer.

FIG. 5 illustrates the carpet web after a first dye color has been applied over the gum layer. As illustrated, an irregular layer of dye material covers the gum coating formed on the tips of the pile yarns 20. This dye material is preferably at the lower end of the viscosity range, i.e. approximately 20–40 c.p.s., so that the dye flows over and around the globs of gum on the tips and through the gum coating and onto the pile yarns 20. In the process of doing so, the edges of the tips may accept some dye, but the surface of the tips remain essentially undyed and the major portion of the dye is accepted by the body portion 26 of the yarn.

Figure 6:
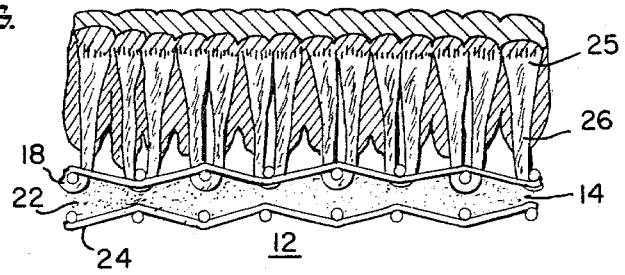
FIGS. 6 and 7 relate to the application of multiple dye colors onto the gum layer.

In FIG. 6, a second dye color of relatively low viscosity, i.e. 50 c.p.s., has been applied over a first dye color of higher viscosity, i.e., 100 c.p.s. The first dye color has been applied over a gum layer of relatively high viscosity, i.e., 1,000 c.p.s. Although, not shown, it should be apparent that the first color can be premixed with the gum which acts as a carrier for the dye. The second dye color penetrates and flows around the beadlets of the first applied dye color and gum layer and down the sides of the individual yarns 20 toward the lower body portions thereof. The surface tips of the yarn are effectively shielded by the gum coating and substantially free from the second applied dye color. However, the first applied dye color may experience some blending with the second applied dye color, as it rolls over the gum and second applied dye colors, which blends flow downwardly. Some of the dye may be applied at the edges of the face yarn, but the major portion of the second applied dye color is accepted at the lower body portions of the face yarn as more clearly shown in FIG. 7.

Figure 7:
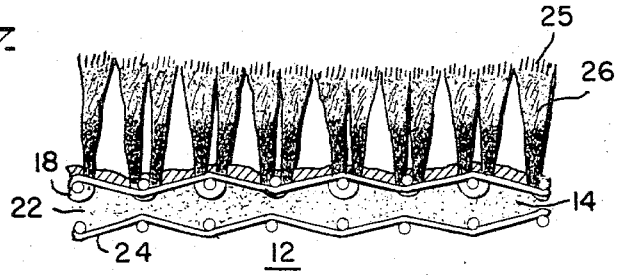

FIG. 7 illustrates the carpet web after it has been passed through the steamer. The gum coating 46 has been thinned out and fallen to the lowermost base portion of the yarns. The dye colors in the meantime have penetrated the yarns and been set. The tips have been dyed with the first applied color, the lower body portion has been dyed with the second applied color, and the edges of the tips and the area adjacent and immediately below the edges have been dyed with a blend of both colors. The final color pattern on the carpet pile thus takes on a unique multi-color tonal effect with complementary color tone shading of the primary colors.

Upon exiting from the steamer 50, the dyed carpet is conveyed to one or more conventional wash boxes 60, 62 where the gum materials are washed out and thence to an overhead dryer 64 from where it is extracted to a collecting box 66. The dryed carpet is then extracted and rolled in a conventional manner.

Figure 8:
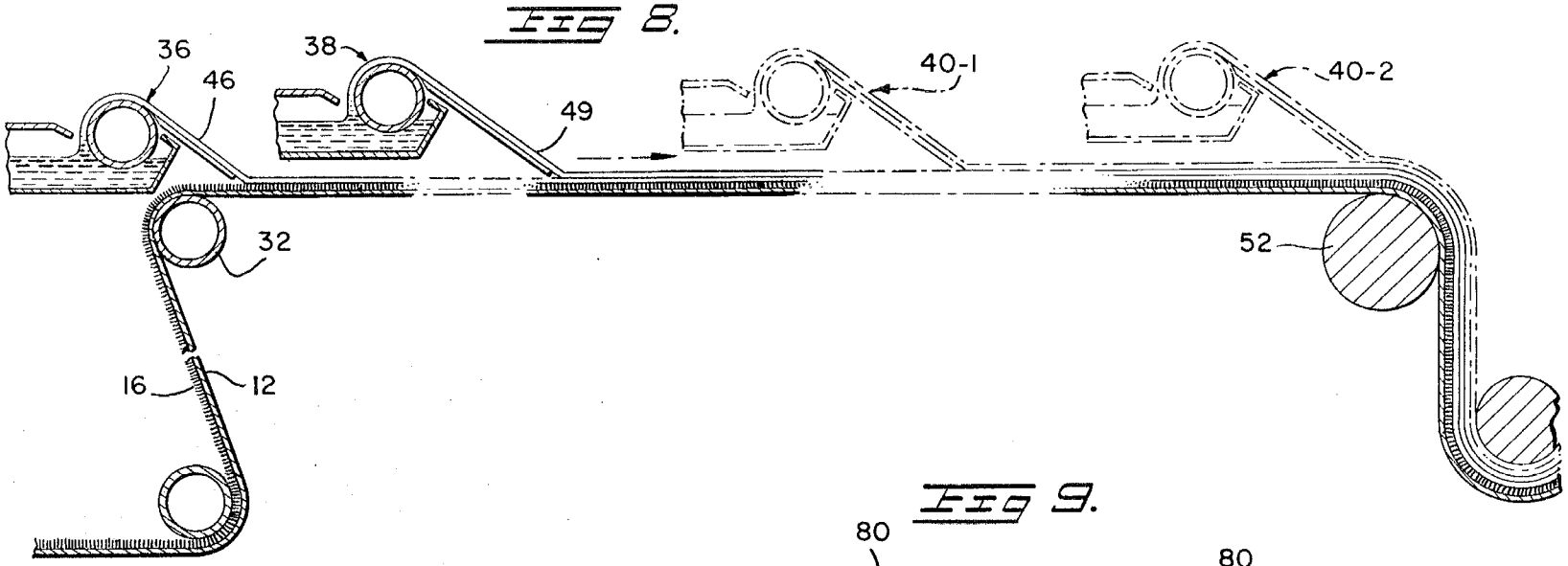
FIG. 8 is an enlarged fragmentary vertical section taken through the applicating units showing the use of two serially arranged applicator units with additional units illustrated in phantom.
Figure 9:
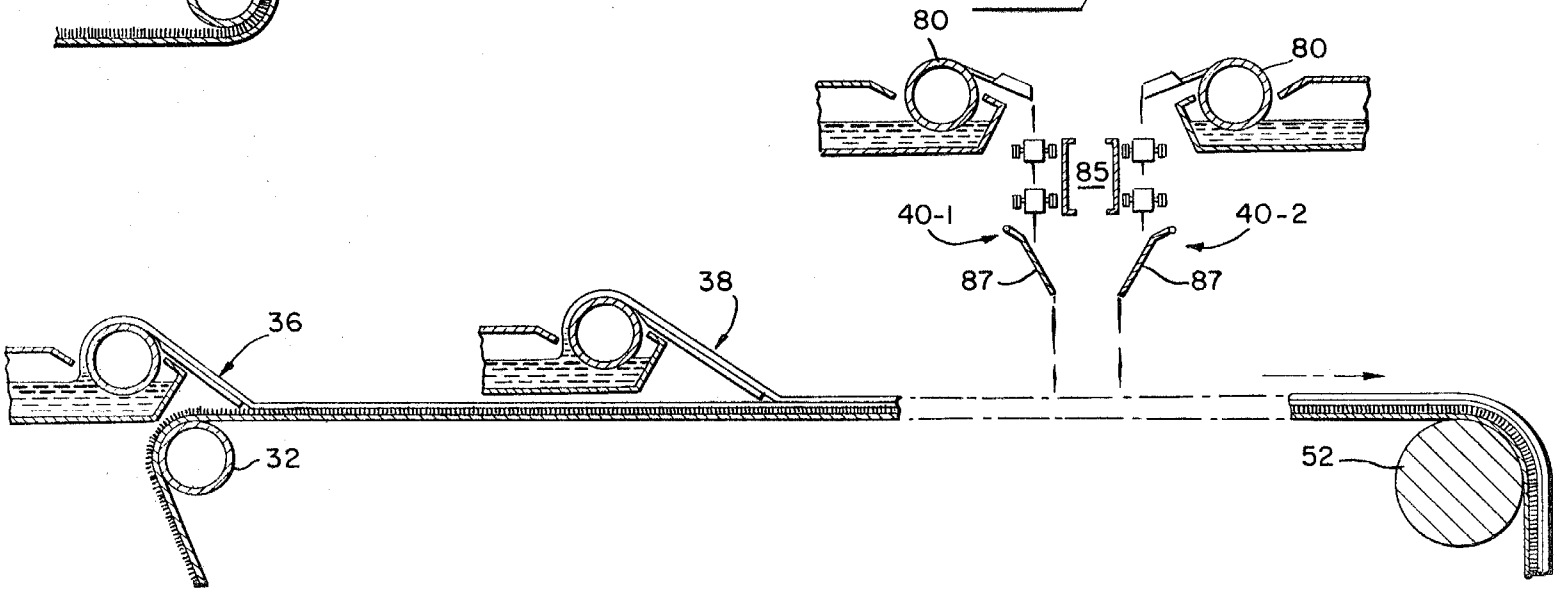
FIG. 9 is an enlarged fragmentary vertical section of an alternate embodiment of the applicator arrangement showing use of a tac applicator downstream of the series applicators of FIG. 8.

A preferred embodiment of the application of a gum coating and dye coating is shown in FIG. 8 wherein two roll applicators are positioned, the first applicator 36 applies a gum coating 46 to the web which has a selected dye color mixed therewith. The second dye applicator 38 applies the second dye color 49. Additional dye applicators 40-1, 40-2, shown in phantom line, may be provided for the application of additional dye color. Said dye colors are generally of different viscosities within the range specified and one or more of the applicators may provide an additional gum coating. Alternatively, applicator 40 may be of the tac type as shown in FIG. 9 wherein a gum coating is applied from the upstream trough while a dye color is applied from the downstream trough. Of course, if desired, both troughs may be filled with different dye colors.

While a preferred embodiment of the invention has been described, it will be readily apparent to those skilled in the art that various changes thereto may be made without departing from the true spirit or full scope of the invention as defined in the appended claims.

I claim:

1. A system for coloring the pile yarns of a carpet web or the like including means for continuously conveying the web through several successive operating stations, means for pretreating the pile yarns to be colored with a wetting agent at one of said operating stations, roll applicator means for applying to the surface tips of the pile yarns a continuous layer of viscous gum coating approximately $\frac{1}{8}$ to $\frac{1}{4}$ inch thick at a second operating station, roll applicator means at a third operating station for applying on said viscous gum coating a continuous layer of dyeing agent approximately $\frac{1}{8}$ to $\frac{1}{4}$ inch thick to color the surface of the lower body portion of the yarns beneath the tips of said pile yarns coated with said gum coating as said web is conveyed and steamer means at a fourth operating station for subjecting said web to an elevated temperature for setting said dye color, said steamer means being disposed downstream of said third station a sufficient distance such that said applied dyeing agent penetrates said gum layer before reaching said fourth station such that only the lower body portions of the pile yarns are colored and the tips of said pile yarns are substantially undyed.

2. A system as set forth in claim 1 wherein the viscosity of said dyeing agent is in the range of approximately 20 to 400 c.p.s. and less than the viscosity of the gum.

3. A system as set forth in claims 1 or 2 wherein each said roll applicator includes a rotatably driven pick up roll disposed in a trough and a doctor blade adjacent said roll for delivering to the web said layer of gum coating and said continuous layer of a dyeing agent in the prescribed thicknesses.

4. A system for coloring the pile yarns of a pile carpet web including means for continuously conveying the web between an upstream station and a downstream station with the pile face of the carpet web disposed upwardly, pretreating means disposed at the upstream end for applying a wetting agent to said pile yarns, means for applying a blanket layer of gum over the tips of the pretreated pile yarns during downstream movement of said web, said gum layer having a viscosity in the range of 100 to 1600 c.p.s., means for applying on said gum coating during further downstream movement of said web a dyeing agent having a viscosity in the range of approximately 20 to 400 c.p.s. for said yarns capable of penetrating said gum coating, a steaming means at the downstream station, said steaming means being a sufficient downstream distance from said dyeing agent applying means to allow said dyeing agent to penetrate said gum coating while said carpet is being conveyed and to flow beyond the tips of the pile yarns to the lower body portion thereof leaving said tips substantially free of dyeing agents and said steaming means being operable to subject said web to an elevated temperature for setting the color of the dyeing agent substantially in the lower body portion of said pile yarns with said tips being substantially free of color.

5. A system for multi-color dyeing of upstanding pile yarns of a carpet web comprising means for continuously conveying the carpet web through several operating stations, first roll applicator means at a first operating station for applying on the tips of said upstanding pile yarns a continuous blanket layer of viscous gum of a viscosity in the range of 100 to 2000 c.p.s. having a first dyeing agent mixed therewith, second applicator means for applying at a second operating station a second dyeing agent on said blanket layer having a viscosity in the range of 20 to 400 c.p.s. such that during movement of said carpet web from the second operation station to a third operating station said second dyeing agent penetrates through said gum coating to the lower body portions of said pile yarns below the tips and heating means at said third operating station for subjecting said carpet web to an elevated temperature at the third operating station to render said gum less viscous so as to allow said first dyeing agent to penetrate to the tips of said carpet yarns and to set said dyeing agents in said yarn such that the color of the lower body portions of said pile yarns is a first color corresponding to that of the second agent and the color of the tips of the pile yarns is a second color corresponding to that of the first agent, said heating means being disposed downstream of said second operating station to a distance sufficient to enable the penetration by said second dyeing agent to take place prior to setting of the dyeing agents.

6. Apparatus for multi-color dyeing upstanding pile yarns as set forth in claim 5 wherein said means for applying the gum layer is disposed sufficiently upstream of said heating means to allow said second dyeing agent to mix with a portion of said first dyeing agent before being set to form a blend thereof which penetrates said gum coating to an area intermediate the tips of said pile yarns and the lower body portion of said yarns, such that said intermediate area is colored to a blend of the color corresponding to the colors of said first and second dyeing agents.

* * * * *